United States Patent [19]

Clark et al.

[11] 4,017,417

[45] Apr. 12, 1977

[54] IMMOBILIZATION OF IODINE IN CONCRETE

[75] Inventors: Walter E. Clark; Clarence T. Thompson, both of Oak Ridge, Tenn.

[73] Assignee: The United States of America as represented by the United States Energy Research and Development Administration, Washington, D.C.

[22] Filed: July 30, 1976

[21] Appl. No.: 710,087

[52] U.S. Cl. ..... 252/301.1 W; 106/97

[51] Int. Cl.[2] ..... G21F 9/16

[58] Field of Search ..... 252/301.1 W; 106/97; 423/2, 163; 176/37; 210/42 R

[56] References Cited

UNITED STATES PATENTS

| | | | |
|---|---|---|---|
| 2,737,449 | 3/1956 | Thomsen | 423/163 |
| 3,013,978 | 12/1961 | Rosinski | 210/42 R |
| 3,434,978 | 3/1969 | Vogel | 106/97 |
| 3,752,876 | 8/1973 | Cathers | 423/240 |
| 3,950,178 | 4/1976 | Jaklin | 106/97 |

OTHER PUBLICATIONS

Chemical Abstracts, vol. 80, No. 9578d (1974), "Co-precipitation of Fission Products with Magnesium Hydroxide."

*Primary Examiner*—Benjamin R. Padgett
*Assistant Examiner*—Deborah L. Kyle
*Attorney, Agent, or Firm*—Dean E. Carlson; David S. Zachry; Allen H. Uzzell

[57] ABSTRACT

A method for immobilizing fission product radioactive iodine recovered from irradiated nuclear fuel comprises combining material comprising water, Portland cement and about 3-20 wt. % iodine as $Ba(IO_3)_2$ to provide a fluid mixture and allowing the fluid mixture to harden, said $Ba(IO_3)_2$ comprising said radioactive iodine. An article for solid waste disposal comprises concrete prepared by this method.

10 Claims, 2 Drawing Figures

IMMOBILIZATION OF IODINE IN CONCRETE

BACKGROUND OF THE INVENTION

This invention was made in the course of, or under a contract with the Energy Research and Development Administration. It relates in general to reactor waste solidification and more specifically to the immobilization of fission product radioactive iodine recovered from irradiated nuclear fuel for underground storage.

Nuclear fission processes produce various radioactive iodine isotopes, all of which decay to insignificant levels of activity within one year except $^{129}I$ which has a half-life of $16 \times 10^6$ years. Fission product radioactive iodine is recovered from irradiated nuclear fuels during reprocessing and in the event of reactor accidents involving fuel failure. Iodine is a biologically active element which tends to be concentrated in living organisms including man. Unless radioactive iodine is permanently removed from the biosphere it will become more and more prevalent in the environment.

Current waste management proposals call for conversion of radioactive waste to a solid form and subsequent disposal in geological formations which have been stable for millions of years. Suitable burial sites will undoubtedly be those which have had no contact with subsurface waters for millions of years, such as bedded salt formations. Nevertheless solid waste packages should be highly resistant to water leaching in the unlikely event of unforeseen geological changes

PRIOR ART

Several proposals in the prior art involve the incorporation of radioactive compounds in an inert matrix such as cements, plastics, asphalt, ceramics and glasses. Cement has been used for some time to immobilize solid fission products which have half-lives too long allow their decay and release to the environment, but are present in quantities small enough that heat generation does not adversely effect the structural integrity of the resulting concrete. Generally the fission product is first converted to an insoluble form either by precipitation as an insoluble compound or by absorption on some inert solid (Grundite clay for example) which is subsequently combined with cement to form concrete. The insoluble clays, etc. function in the concrete as an aggregate. Such compositions are more fully described in Moore, et al. "Development of Cementitious Grouts for the Incorporation of Radioactive Wastes, Part I: Leach Studies" ORNL-4962, Oak Ridge National Laboratory, Oak Ridge, Tennessee (1975). These methods generally involve combining the desired volume of a liquid waste solution with a predetermined weight of dry solids consisting of type I Portland cement, fly ash, Attapulgite clay, Grundite clay and a sugar. The sugar was used as a retarder to prevent the grout from hardening too rapidly for use in hydrofracturing techniques of underground storage. The fly ash functioned as a pozzulana. The prior art processes are not specific for radioactive iodine and mostly depend upon such effects as ion exchange and adsorbtion on otherwise inert materials such as clays, etc. These inert materials retain relatively small amounts of iodine and other radioisotopes and the resulting concrete therefore requires a large storage volume.

SUMMARY OF THE INVENTION

It is an object of this invention to provide a method for immobilizing radioactive iodine for solid waste disposal which produces a highly leach resistant iodine-containing article.

It is a further object to provide a solidification process for radioiodine which is compatible with existing methods for recovering radioactive iodine from irradiated reactor fuel.

It is a further object to provide a radioiodine-containing article highly resistant to water leaching and suitable for underground storage.

It is a further object to eliminate the need for clays etc. to retain the radioactive species and thereby reduce the volume of the ultimate waste storage article.

These and other objects are accomplished according to our invention in a method for immobilizing fission product radioactive iodine recovered from irradiated nuclear reactor fuel, said method comprising combining material comprising water, Portland cement and about 3–20 wt. % iodine as $Ba(IO_3)_2$ to provide a fluid mixture and allowing the fluid mixture to harden, said $Ba(IO_3)_2$ comprising said radioactive iodine. For purposes of this invention wt. % iodine is with respect to the total weight of hardened concrete. $Ba(IO_3)_2$ is meant to include hydrates as well as anhydrous salts. This method provides a highly water leach resistant concrete article which is suitable for encasement and underground storage. Preferably, a waterproofing agent such as butyl stearate is added to the fluid concrete mixture to retard leach from the resulting article. The preferred method of carrying out our process is to contact an aqueous radioactive waste solution containing $HIO_3$ or $HI_3O_8$ (such as is readily provided from radioiodine gas scrubbing processes such as Iodox) with a source of barium ions such as a soluble barium salt to cause the precipitation of $Ba(IO_3)_2$. Preferably the liquid mixture is then contacted with sufficient Portland cement to form a concrete article using the entire waste stream for hydration. The precipitated $Ba(IO_3)_2$ functions as the aggregate of the concrete.

DETAILED DESCRIPTION

Figure 1:
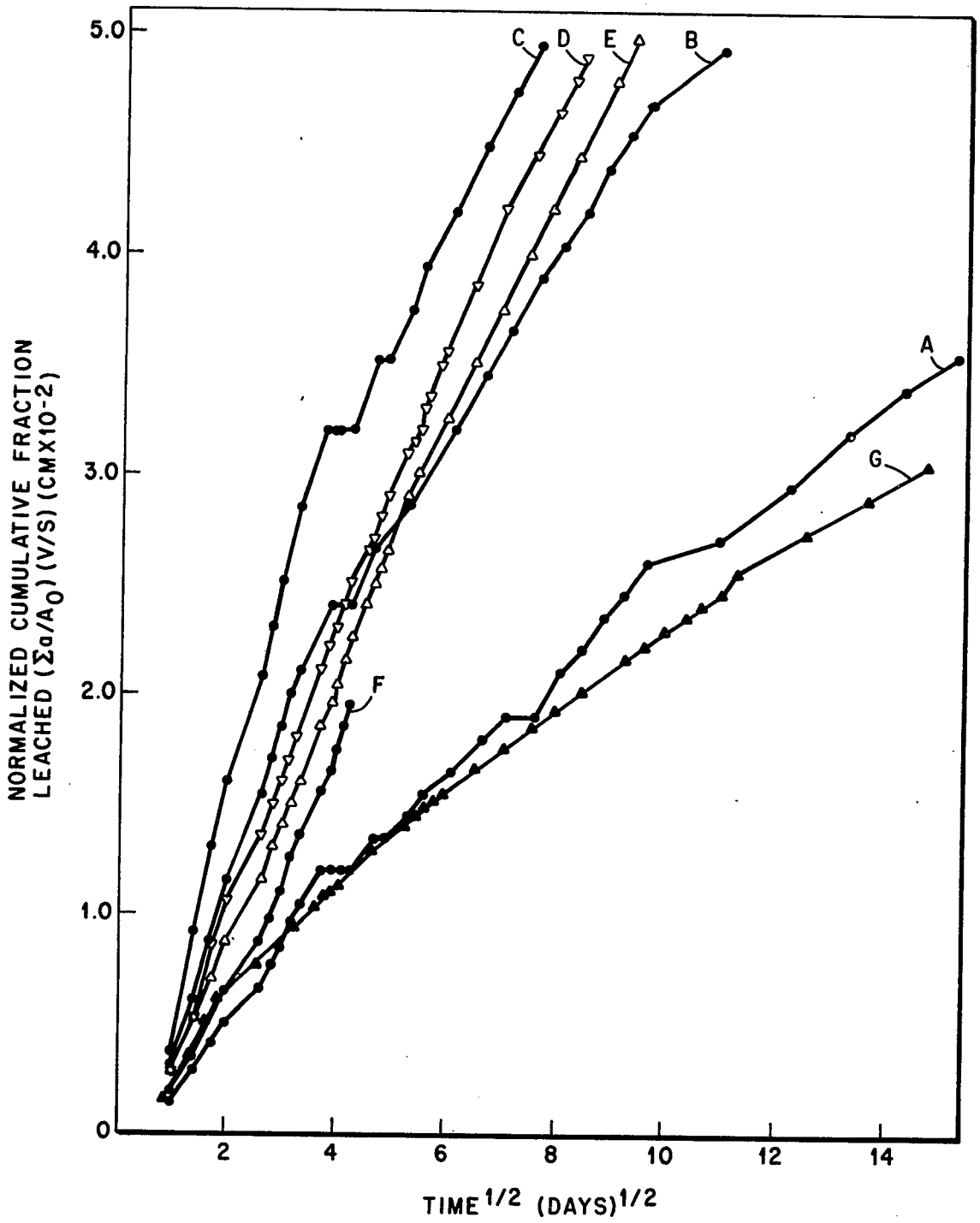
FIG. 1 is a graph of cumulative fraction leached vs. time for concrete containing several concentrations of $Ba(IO_3)_2$.

Our invention comprises a method for immobilizing radioactive iodine in concrete and a leach-resistant concrete composition for use in fabricating articles for the underground storage of radioactive iodine. According to our invention, radioactive iodine such as is recovered from the reprocessing of irradiated nuclear fuels is chemically converted to $Ba(IO_3)_2$ and combined with Portland cement and water to form concrete. Since our concrete is highly resistant to water leach the iodine content may range from about 3 to 20% by weight. This is substantially higher than other waste solidification processes. Since the predominant radioisotope in fission product iodine $I^{129}$ has a very low decay constant, the amount of radioactive iodine which can be incorporated is not limited by heat generation but by the maximum amount of $Ba(IO_3)_2$ which may be present in the concrete mixture and still provide a fluid, castabale mix. This maximum amount corresponds to about 20% by weight iodine.

An important aspect of our invention lies in the discovery that a particular iodine compound, $Ba(IO_3)_2$, possesses a unique unexpected property, beneficial to the art of radioactive waste solidification. When radioactive iodine in the form of $Ba(IO_3)_2$ is combined with Portland cement and water and allowed to harden, a concrete article is formed which is unexpectedly resistant to water leach of the radioactive iodine species. This unexpected behavior permits the incorporation of large quantities of fission product iodine in small volumes of concrete. Accordingly, concrete prepared according to our process requires no sorbtion media or additional aggregate material since $Ba(IO_3)_2$ can be added in sufficient amounts to make up the entire aggregate. Of course other materials such as fly ash, clays and even other radioactive waste may be added to the fluid mixture but the amount of iodine permissible would be correspondingly reduced. To reduce storage volume it is preferred that the concrete contain no additional inert materials. It is also preferred that the concrete mixture contain a small amount of waterproofing agent to retard leach. Since in our method $Ba(IO_3)_2$ can be added to the mixture to make up the entire aggregate, our method is substantially preferable to prior art methods requiring clays etc. for sorbtion of radioactive species.

We have found that concrete prepared with $Ba(IO_3)_2$ is unexpectedly more resistant to water leach of radioactive species than concrete prepared with other iodates having lower solubilities. We have also found that the incremental leach rate (amount leached per unit time/amount originally present) of iodine from our concrete increases with increasing iodine content up to a point of about 7.5% by weight iodine and thereafter remains constant or actually decreases. This is a particularly important property since it permits the incorporation of large quantities of radioiodine (7.5% to about 20 wt. %) in small volumes of concrete, without significantly increasing the incremental leach rate, thereby substantially reducing the requirement for expensive storage space.

While our waste immobilization process is independent of the method of recovering radioiodine from reactor waste, an important advantage is the adaptability of existing fission product radioactive iodine recovery methods to producing $Ba(IO_3)_2$ required for our process. At least two prior art processes provide $HIO_3$ or $HI_3O_8$ which are readily converted to $Ba(IO_3)_2$ by contacting in aqueous solution with a source of barium ions. Since $BA(IO_3)_2$ forms as an insoluble precipitate in aqueous solution, the source of barium ions may be any compound such as a soluble salt which yields barium ions in aqueous solution. The preferred source of barium ions is $BA(OH)_2$ to avoid extraneous ions. For example, fission product radioactive iodine is recovered in the Iodox process by contacting a gaseous waste stream containing radioactive $I_2$ and $CH_3I$ with hyperazeotropic nitric acid to cause $I_2$ and $CH_3I$ to be oxidized to $HIO_3$ and precipitated as $HI_3O_8$. The precipitate can be filtered off and dissolved in a small amount of water (e.g., about 3 to 1 $HI_3O_8$ to $H_2O$) to provide a solution containing radioactive iodine. To this solution may be added $Ba(OH)_2$ to precipitate $Ba(IO_3)_2$. The Iodox process is more fully described in U.S. Pat. No. 3,752,876 to Cathers et al., issued Aug. 14, 1973 for "Removal of Organic and Inorganic Iodine from a Gaseous Atmosphere" which is herein incorporated by reference. A second process producing an aqueous radioactive waste solution containing $HIO_3$ is provided by the process disclosed in commonly assigned U.S. Patent Application Ser. No. 661,571 filed Feb. 26, 1976, by Horner et al, for "Electrolytic Trapping of Iodine from Process Gas Streams." This process produces an aqueous acid solution (about 4–16 M $HNO_3$) containing dissolved iodate ions. Nitric acid may be distilled off resulting in a solution of $HIO_3$ which precipitates $Ba(IO_3)_2$ upon addition of a source of barium ions such as $Ba(OH)_2$. When concrete is prepared according to our invention from liquid waste containing radioactive iodine in the form of dissolved iodate (such as $HIO_3$), it is preferred that the entire waste solution be used to make up the concrete to avoid the production of additional radioactive side streams. The liquid content can be adjusted, e.g., by evaporation to provide the desired water to cement ratio.

To demonstrate the unexpected resistance to water leach of concrete containing $Ba(IO_3)_2$ as an aggregate, the following experimental data is presented. A series of concrete specimens of the same size were prepared containing from 2.9–15 wt. % iodine as $Ba(IO_3)_2$. Type 1 Portland cement was used in all cases because of its low cost and general availability. Other types of Portland cement are similarly useful for immobilizing radioiodine according to our process. The components of the concrete samples are listed in the following table.

Table 1

| Sample | Component (wt. %) Cement | Water | $Ba(IO_3)_2$ | Additives | Wt. % Iodine |
|---|---|---|---|---|---|
| A | 53.7 | 40.8 | 5.5 | 0 | 2.9 |
| B | 50.0 | 39.8 | 10.2 | 0 | 5.4 |
| C | 46.7 | 38.9 | 14.4 | 0 | 7.5 |
| D | 44.2 | 38.3 | 17.5 | 0 | 9.05 |
| E | 41.9 | 35.0 | 23.1 | 0 | 11.9 |
| F | 23.0 | 38.4 | 38.6 | 0 | 15.0 |
| G | 44.2 | 37.3 | 17.5 | Butyl Stearate 0.9 | 9.05 |

$Ba(IO_3)_2$ was prepared by reacting reagent grade $HIO_3$ with a slight stiochiometric excess of aqueous $Ba(OH)_2$. The volumes of water were chosen so that the resulting slurry supplied all the water needed for making up the concrete. The cement to total water ratio varied from 0.6 – 1.43. The total water content must be computed taking into account the water of hydration of barium hydroxide which is added as $Ba(OH)_2 \cdot 8H_2O$ and the water produced by the reaction of $Ba(OH)_2$ with $HIO_3$ or $HI_3O_8$. The samples were made up by mixing in a conventional blender at speeds varying from a few hundred to about 1000 rpm for the mixing process. The fluid concrete mixture was poured into 5 cm. diameter by 5 cm. high cylindrical polyethylene containers to conform with the specified dimensions of the International Atomic Energy Agency. After pouring, the samples were allowed to stand in a water-saturated atmosphere for 28 days or longer. Great care wss taken to remove the air bubbles from the cement by shaking and slow stirring so that the samples filled the container snugly.

Static leaching tests were run under a minimum water depth of 5 cm. In the containers used, the volume of distilled water required for leaching was 300 ml. Water sampling was initially carried out daily for some specimens, however after three or four weeks sampling was carried out weekly. The leachant was replaced weekly. In no case did the $Ba(IO_3)_2$ content of the leach water exceed 25% of the solubility. Analyses were carried out with a conventional spectrophotometer. The results are depicted in FIG. 1 which is a graph of the cumulative fraction of Iodine leached multiplied by the volume-to-surface area ratio vs. the square root of the leaching time in days. The surface area is the area of the open end of the container. The cumulative fraction $\Sigma a/A$ is the ratio of sum of the weights of iodine leached in each leaching period to the total initial iodine content of the sample. The square root of the time is plotted to contract the ordinate and to indicate the degree of approximation to the linearity demanded by diffusion theory.

As indicated in FIG. 1, the leach rate increases with increasing iodine content up to about 7.5 weight % iodine. Samples more concentrated than 7.5% iodine actually showed lower fractional leach rates. Accordingly, our invention in its broadest aspects includes concrete mixtures having about 3–20 wt. % iodine as distinguished from most prior art concrete immobilizations containing only about 1 wt. % radioactive material. In our process, at least about 7.5 wt. % iodine is preferred to obtain the advantages of lower fractional leach rates for more concentrated specimens. The preferred iodine content for concrete prepared according to our process is therefore about 7.5–20 wt. %.

The unexpected leach resistance of concrete with an aggregate consisting essentially of $Ba(IO_3)_2$ permits the incorporation of much larger quantities of radioactive iodine with both a decrease in volume of the concrete and a decrease in the amount of radioactive iodine leached from a given quantity of iodine. For example, according to the data depicted in FIG. 1, over a 36 day period it would require 59% more storage articles (of a given size) comprising concrete containing 7.5 wt. % *I* to contain the same quantity of radioactive iodine as concrete containing 11.9% wt. % and the 7.5 wt. % concrete would leach 27% more of the radioactive iodine to the environment.

In order to increase the resistance of the concrete to water leach, a waterproofing agent should be added. Waterproofing agents are well known in the art of concrete preparation and include soaps, heavy oils, and esters such as butyl stearate, etc. Butyl stearate is the preferred waterproofing agent. The amount of waterproofing agent required is not critical and it will undoubtedly vary widely for different agents. The desired amount can be readily determined by routine investigation. Generally about 5 wt. % or less with respect to total concrete weights will be sufficient. For butyl stearate, the desired range is about 0.5 to 1 wt. % with 1 wt. % preferred. The effect of 0.9 wt. % butyl stearate is shown in FIG. 1 as sample G compared to sample D, without a waterproofing agent.

Figure 2:
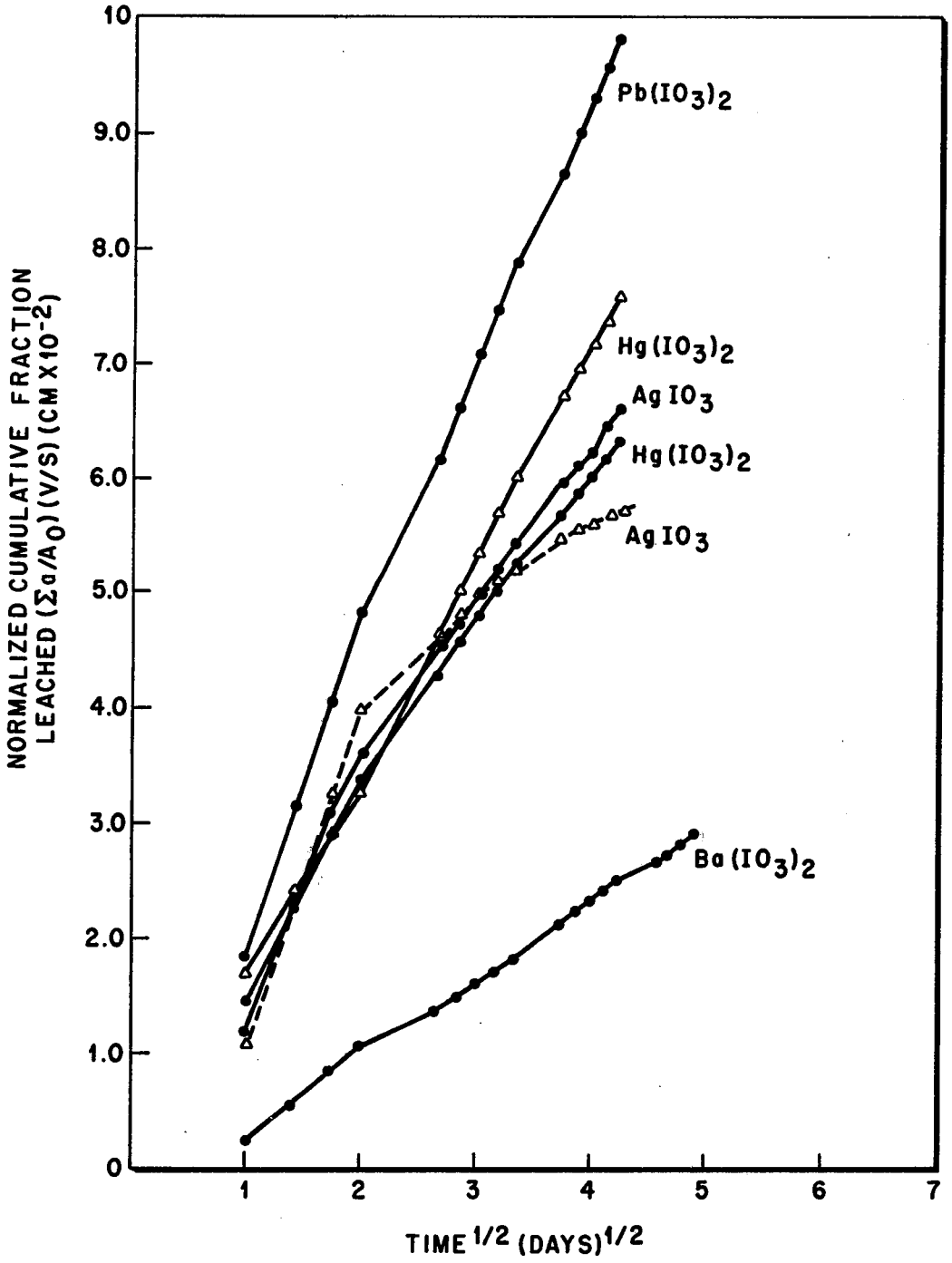
FIG. 2 is a graph of cumulative fraction leached for concrete containing equal amounts of iodine as several insoluble iodates.

Concrete prepared according to our process is substantially more resistant to leach of iodine species than concrete prepared with other insoluble iodates. FIG. 2 depicts the normalized (multiplied by volume/surface area) cumulative fraction of Iodine leached from concretes containing 9.05 wt. % of iodine added in the form of $Ba(IO_3)_2$, $Hg(IO_3)_2$ $AgIO_3$ and $Pb(IO_3)_2$. As depicted, the concrete containing iodine added in the form of barium iodate is substantially more resistant to water leach than are concretes containing other insoluble iodates. This behavior is surprising since $Ba(IO_3)_2$ has a greater solubility in water than does $Pb(IO_3)_2$ and $AgIO_3$ and would normally be expected to leach out of concrete more rapidly. Normally in a leaching test, the rate of mass transfer across the surface is directly proportional to the difference in concentration between the surface of the body and the surrounding leachant. The solubility of $Ba(IO_3)_2$ at 25° C is $8.1 \times 10^{-4}$ g-moles/liter while the lower solubilities of $AgIO_3$ and $Pb(IO_3)_2$ are $1.8 \times 10^{-4}$ and $3.6–5.5 \times 10^{-5}$ g-mole/liter respectively.

The explanation for the unexpected resistance to water leach of concrete prepared with $Ba(IO_3)_2$ is not certain. Apparently $Ba(IO_3)_2$ interacts with Portland cement in a unique way to more tightly bind the iodate and protect it from dissolving by water. The behavior illustrated in FIG. 1 appears to indicate that greater concentrations of $Ba(IO_3)_2$ result in greater resistance to leach. Accordingly, it is believed that $Ba(IO_3)_2$ functions both as an aggregate and as a pozzulana, interacting chemically with the concrete and filling the voids to reduce the amount of contained $Ba(IO_3)_2$ which comes in contact with the leach water. Since $Ba(IO_3)_2$ normally exists as a monohydrate, $Ba(IO_3)_2$ may form a hydrate within pore spaces thereby decreasing the porosity. Another possibility is that $Ba(IO_3)_2$ reacts with sulfate normally present in Portland cement to form insoluble $BaSO_4$ which fills pores and makes the concrete more leach resistant. Regardless of the mechanism involved the net result is that concrete prepared according to our process is unexpectedly more resistant to water leach than concretes prepared with iodates of Ag, Pb and Hg.

DESCRIPTION OF THE PREFERRED EMBODIMENT

The process of our invention will be illustrated by the fixation of radioactive iodine recovered from a nuclear fuel reprocessing effluent gas stream by the Iodox process. This embodiment is for illustrative purposes and is not intended to be limiting.

One thousand liters of solution from the Iodox waste decay tank consisting of 12.4 M $HNO_3$ and containing 93 g/l iodine (75% $^{129}I$, 25% $^{127}I$) as iodate is distilled to remove water and nitric acid and to yield 123.9 kg of solid metaiodic acid $HI_3O_8$. This solid is dissolved in 66 liters of water. A separate slurry is made up by mixing together 123.5 kg of $Ba(OH)_2 . 8H_2O$ and 140 liters of water at about 80° C. To this slurry the solution of $HI_3O_8$ is added with constant stirring to neutralize the acid and to precipitate barium iodate as a solid phase. The stirring is continued to prevent caking of the slurry and to help dissipate the heat of neutralization. During this period 7.8 kg of solid butyl stearate is added. When the temperature has dropped to 35° to 40° C this slurry is added to 320 kg of type 1 Portland cement. The mixture is thoroughly mixed by conventional techniques and poured into steel or plastic drums while the latter are vibrated to remove the entrained air bubbles. The cement is then allowed to harden and then is cured for 28 days in an atmosphere saturated with water vapor. The top of the concrete plugs are then rinsed with a small volume of water to remove any surface $HIO_3$; this water is drained off and used in making up the next batch. The tops of the plugs are then treated with a water-repelling compound (e.g., a polybutene). The drum is then sealed in the conventional manner. The article containing about 11.9 wt. % I is now suitable for long-term underground storage.

The cement-to-water ratio for the concrete is not critical so long as sufficient mechanical strength is assured. Sufficient mechanical strength for underground disposal can be attained by cement-to-total water ratios of about 0.6 to 1.3 with about 0.7–0.9 preferred.

What is claimed is:

1. A method for immobilizing fission product radioactive iodine recovered from irradiated nuclear reactor fuel, said method comprising forming a fluid mixture comprising water, Portland cement, and about 3–20 wt. % iodine as $Ba(IO_3)_2$and allowing the fluid mixture to harden, said radioactive iodine being present in the form of $Ba(IO_3)_2$.

2. The method of claim 1 wherein said mixture contains about 7.5–20 wt. % iodine.

3. The method of claim 1 wherein said mixture further contains a waterproofing agent.

4. The method of claim 3 wherein said waterproofing agent is butyl stearate.

5. The method of claim 1 in which said $Ba(IO_3)_2$ is provided by contacting an aqueous solution containing $HIO_3$ or $HI_3O_8$ with a source of barium ions to precipitate said $Ba(IO_3)_2$.

6. The method of claim 5 in which said source of barium ions is $Ba(OH)_2$.

7. An article for the solid waste disposal of fission product radioactive iodine recovered from irradiated nuclear reactor fuel said article comprising concrete prepared by forming a fluid mixture comprising water, Portland cement, and about 3–20 wt. % iodine as $Ba(IO_3)_2$ and allowing the fluid mixture to harden, said radioactive iodine being present in the form of $Ba(IO_3)_2$

8. The article of claim 7 in which said mixture contains about 7.5–20 wt. % iodine.

9. The article of claim 7 in which said mixture further contains a waterproofing agent.

10. The article of claim 9 in which said waterproofing agent is butyl stearate.

* * * * *